US010293337B2

(12) United States Patent
Qin et al.

(10) Patent No.: US 10,293,337 B2
(45) Date of Patent: May 21, 2019

(54) SINGLE-CELL PIPETTE ASSEMBLY COMPRISING SINGLE-CELL PIPETTE HANDLE AND SINGLE-CELL PIPETTE TIP

(71) Applicant: The Methodist Hospital, Houston, TX (US)

(72) Inventors: Lidong Qin, Houston, TX (US); Kai Zhang, Houston, TX (US)

(73) Assignee: The Methodist Hospital, Houston, TX (US)

( * ) Notice: Subject to any disclaimer, the term of this patent is extended or adjusted under 35 U.S.C. 154(b) by 27 days.

(21) Appl. No.: 15/114,704

(22) PCT Filed: Jan. 28, 2015

(86) PCT No.: PCT/US2015/013343
§ 371 (c)(1),
(2) Date: Jul. 27, 2016

(87) PCT Pub. No.: WO2015/116714
PCT Pub. Date: Aug. 6, 2015

(65) Prior Publication Data

US 2016/0339422 A1 Nov. 24, 2016

Related U.S. Application Data

(60) Provisional application No. 61/932,493, filed on Jan. 28, 2014.

(51) Int. Cl.
*B01L 3/02* (2006.01)

(52) U.S. Cl.
CPC ..... *B01L 3/0275* (2013.01); *B01L 2200/0657* (2013.01); *B01L 2200/0668* (2013.01); *B01L 2300/0832* (2013.01); *B01L 2400/086* (2013.01)

(58) Field of Classification Search
CPC .... B01L 3/02; B01L 3/0275; B01L 2400/086; B01L 2300/0832; B01L 2200/0657; B01L 2200/0668
See application file for complete search history.

(56) References Cited

U.S. PATENT DOCUMENTS 4,427,634 A 1/1984 Truglio
2011/0268628 A1 11/2011 Warhurst et al.
(Continued)

FOREIGN PATENT DOCUMENTS

JP 2013-515009 5/2013
WO WO 2011/075741 6/2011
WO WO 2016/004018 1/2016

OTHER PUBLICATIONS

Brugues A. et al., Forces Driving Epithelial Wound Healing, Nature Physics, Sep. 2014, vol. 10, No. 9, pp. 683-690.
(Continued)

*Primary Examiner* — Sally A Merkling
(74) *Attorney, Agent, or Firm* — Pandiscio & Pandiscio

(57) ABSTRACT

Apparatus for isolating an individual cell from a group of cells and transferring that isolated cell to a desired location, the apparatus comprising: a single-cell pipette tip, the single-cell pipette tip comprising: a structure having a distal end; a Y-shaped microchannel formed in the structure, the Y-shaped microchannel comprising a base microchannel, a first branch microchannel and a second branch microchannel, wherein the base microchannel extends to the distal end of the structure, the first branch microchannel is connectable to a first pressure channel, the second branch microchannel is connectable to a second pressure channel, and a single-cell trap is disposed in the base microchannel, distal to the convergence of the base microchannel with the first branch microchannel and the second branch microchannel.

33 Claims, 19 Drawing Sheets

(56) References Cited

U.S. PATENT DOCUMENTS

| | | | | |
|---|---|---|---|---|
| 2012/0019270 | A1 | 1/2012 | Amodei et al. | |
| 2012/0264134 | A1 | 10/2012 | Ionescu-Zanetti et al. | |
| 2013/0078163 | A1 | 3/2013 | Chung et al. | |
| 2017/0203290 | A1* | 7/2017 | Ando | B01L 3/0275 |

OTHER PUBLICATIONS

Puliafito A. et al., Collective and Single Cell Behavior in Epithelial Contact Inhibition, PNAS, Jan. 17, 2012, vol. 109, No. 3, pp. 739-744.

Ricci-Vitiani L. et al., Tumour Vascularization via Endothelial Differentiation of Glioblastoma Stem-Like Cells, Nature, Dec. 9, 2010, vol. 468, pp. 824-838.

Zhang K. et al., Hand-Held and Integrated Single-Cell Pipettes, Journal of the America Chemical Society, 2014, vol. 136, pp. 10858-10861.

Zhang K. et al., Single-Cell Isolation by a Modular Single-Cell Pipette for RNA-Sequencing, Lab on a Chip, Royal Society of Chemistry, Nov. 2, 2016, vol. 16, pp. 4742-4748.

Kobel et al., Optimization of Microfluidic Single Cell Trapping for Long-Term On-Chip Culture, Lab on a Chip, Jan. 13, 2010, vol. 10, pp. 857-863.

* cited by examiner

Table S1. Single-cell capture efficiency with various bypass path widths.

| $W_b$/μm | 15 | 18 | 20 | 22 | 27 |
|---|---|---|---|---|---|
| $L_b$/ μm | 18 | 18 | 18 | 18 | 18 |
| $D$/ μm | 12 | 12 | 12 | 12 | 12 |
| $R_c/R_b$ | 24 | 31 | 36 | 41 | 54 |
| $W_b/D$ | 1.25 | 1.5 | 1.67 | 1.83 | 2.25 |
| $C$/no. per mL | $10^7$ | $10^7$ | $10^7$ | $10^7$ | $10^7$ |
| $t$/s | 5 | 5 | 5 | 5 | 5 |
| $\alpha$/° | 15 | 30 | 45 | 60 | --- |
| $E$/% | 76.7 | 86.7 | 96.7 | 90 | 83.3 |

$W_b$, width of the bypass path; $L_b$, length of the bypass path; $D$, average diameter of SK-BR-3 breast cancer cells; $R_c$, fluid resistance along the capture path; $R_b$, fluid resistance along the bypass path; $C$, cell number per mL; $t$, aspirating time; $\alpha$, angle between the $x$-axis and the line intersecting the nuclei of two cells; $E$, percentage of average single-cell capture efficiency

FIG. 10D

Table S2. Single-cell capture efficiency with various bypass path lengths.

| $W_b$/μm | 20 | 20 | 20 | 20 | 20 |
|---|---|---|---|---|---|
| $L_b$/ μm | 18 | 65 | 130 | 260 | 650 |
| $D$/ μm | 12 | 12 | 12 | 12 | 12 |
| $R_c/R_b$ | 36 | 10 | 5 | 2.5 | 1 |
| $W_b/D$ | 1.67 | 1.67 | 1.67 | 1.67 | 1.67 |
| $C$/no. per mL | $10^7$ | $10^7$ | $10^7$ | $10^7$ | $10^7$ |
| $t$/s | 5 | 5 | 5 | 5 | 5 |
| $\alpha$/° | 45 | 45 | 45 | 45 | 45 |
| $E$/% | 36.7 | 53.3 | 70 | 86.7 | 96.7 |

$W_b$, width of the bypass path; $L_b$, length of the bypass path; $D$, average diameter of SK-BR-3 breast cancer cells; $R_c$, fluid resistance along the capture path; $R_b$, fluid resistance along the bypass path; $C$, cell number per mL; $t$, aspirating time; $\alpha$, angle between the $x$-axis and the line intersecting the nuclei of two cells; $E$, percentage of average single-cell capture efficiency

FIG. 10E

SINGLE-CELL PIPETTE ASSEMBLY COMPRISING SINGLE-CELL PIPETTE HANDLE AND SINGLE-CELL PIPETTE TIP

REFERENCE TO PENDING PRIOR PATENT APPLICATION

This patent application claims benefit of prior U.S. Provisional Patent Application Ser. No. 61/932,493, filed Jan. 28, 2014 by The Methodist Hospital and Lidong Qin et al. for SINGLE CELL PIPETTE (SCP) AND SINGLE CELL PIPETTE TIP (SCP-TIP), which patent application is hereby incorporated herein by reference.

FIELD OF THE INVENTION

This invention relates to cell manipulation in general, and more particularly to isolating an individual cell from a group of cells and transferring that isolated cell to a desired location.

BACKGROUND OF THE INVENTION

Current biological research and clinical cell analysis frequently requires the isolation of an individual cell from a group of cells and the transfer of that isolated cell to a desired location (e.g., common 96- or 384-well plates, cell culture dishes, vials, microscope slides, etc.). Ideally, such isolation and transfer should be well controlled, highly efficient, operationally simple, fast to implement and inexpensive. However, for a variety of reasons, none of the approaches available to date are completely satisfactory.

Thus, a new approach is needed for isolating an individual cell from a group of cells and transferring that isolated cell to a desired location.

SUMMARY OF THE INVENTION

The present invention provides a new approach for isolating an individual cell from a group of cells and transferring that isolated cell to a desired location.

More particularly, the present invention provides a novel single-cell pipette assembly for isolating an individual cell from a group of cells and transferring that isolated cell to a desired location.

In one preferred form of the invention, the single-cell pipette assembly comprises a single-cell pipette handle and a single-cell pipette tip. The single-cell pipette handle comprises a first pressure channel and a second pressure channel. The single-cell pipette tip comprises a Y-shaped microchannel having a base microchannel, a first branch microchannel and a second branch microchannel. The base microchannel extends to the distal end of the single-cell pipette tip. The first branch microchannel of the Y-shaped microchannel is connected to the first pressure channel of the single-cell pipette handle. The second branch microchannel of the Y-shaped microchannel is connected to the second pressure channel of the single-cell pipette handle. A single-cell trap is disposed in the base microchannel of the Y-shaped microchannel, distal to the convergence of the base microchannel with the first branch microchannel and the second branch microchannel.

On account of the foregoing construction, when the base microchannel, first branch microchannel and second branch microchannel are primed with primer solution, and the base microchannel is disposed in a slurry of cells, and negative pressure is applied to the first pressure channel, the slurry of cells is drawn up into the base microchannel and into the first branch microchannel, with a single cell from the slurry being captured in the single-cell trap. Next, the base microchannel is disposed in a wash solution, and negative pressure is applied to the first pressure channel so that the wash solution flushes the slurry of cells out of the base microchannel, with the captured cell remaining in the single-cell trap. Thereafter, when the single cell captured in the single-cell trap is to be transferred to a desired location, positive pressure is applied to the second pressure channel so that the primer solution is flushed through the second branch microchannel, into the base microchannel and then out the distal end of the single-cell pipette tip, whereby to flush the captured cell out of the single-cell trap, through the base microchannel and then out the distal end of the single-cell pipette tip.

In one preferred form of the present invention, there is provided apparatus for isolating an individual cell from a group of cells and transferring that isolated cell to a desired location, said apparatus comprising:

a single-cell pipette tip, said single-cell pipette tip comprising:

a structure having a distal end;

a Y-shaped microchannel formed in said structure, said Y-shaped microchannel comprising a base microchannel, a first branch microchannel and a second branch microchannel, wherein said base microchannel extends to said distal end of said structure, said first branch microchannel is connectable to a first pressure channel, said second branch microchannel is connectable to a second pressure channel, and a single-cell trap is disposed in said base microchannel, distal to the convergence of said base microchannel with said first branch microchannel and said second branch microchannel.

In another preferred form of the present invention, there is provided a method for isolating an individual cell from a group of cells and transferring that isolated cell to a desired location, said method comprising:

providing a single-cell pipette tip, said single-cell pipette tip comprising:

a structure having a distal end;

a Y-shaped microchannel formed in said structure, said Y-shaped microchannel comprising a base microchannel, a first branch microchannel and a second branch microchannel, wherein said base microchannel extends to said distal end of said structure, said first branch microchannel is connectable to a first pressure channel, said second branch microchannel is connectable to a second pressure channel, and a single-cell trap is disposed in said base microchannel, distal to the convergence of said base microchannel with said first branch microchannel and said second branch microchannel;

priming said base microchannel, said first branch microchannel and said second branch microchannel with primer solution;

positioning said base microchannel in a slurry of cells;

applying negative pressure to said first branch microchannel and said base microchannel so that the slurry of cells is drawn up into said base microchannel and into said first branch microchannel, with a single cell from the slurry being captured in said single-cell trap;

positioning said base microchannel in a wash solution;

applying negative pressure to said first branch microchannel and said base microchannel so that said wash solution flushes the slurry of cells out of said base microchannel, with the captured cell remaining in said single-cell trap; and thereafter, when the single cell captured in said single-cell trap is to be transferred to a desired location, applying positive pressure to said second pressure channel so that said primer solution is flushed through said second branch microchannel, into said base microchannel and then out said distal end of said single-cell pipette tip, whereby to flush the captured cell out of said single-cell trap, through said base microchannel and then out said distal end of the single-cell pipette tip.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein:

FIG. 10D is a table showing single-cell capture efficiency with various bypass path widths;

FIG. 10E is a table showing single-cell capture efficiency with various bypass path lengths;

DETAILED DESCRIPTION OF THE PREFERRED EMBODIMENTS

Figure 1:
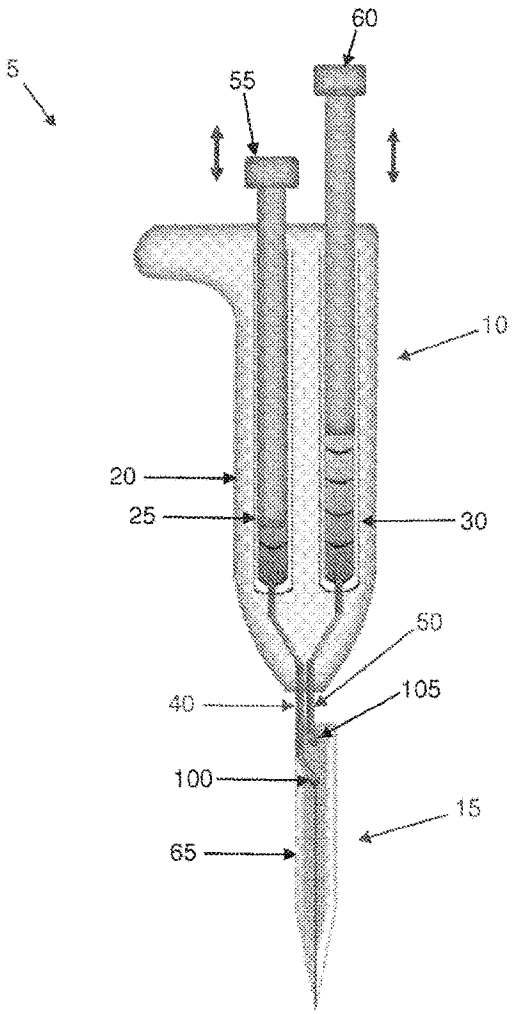
FIG. 1 is a schematic view showing a novel single-cell pipette assembly formed in accordance with the present invention, wherein the single-cell pipette assembly comprises a single-cell pipette handle and a single-cell pipette tip.
Figure 4:
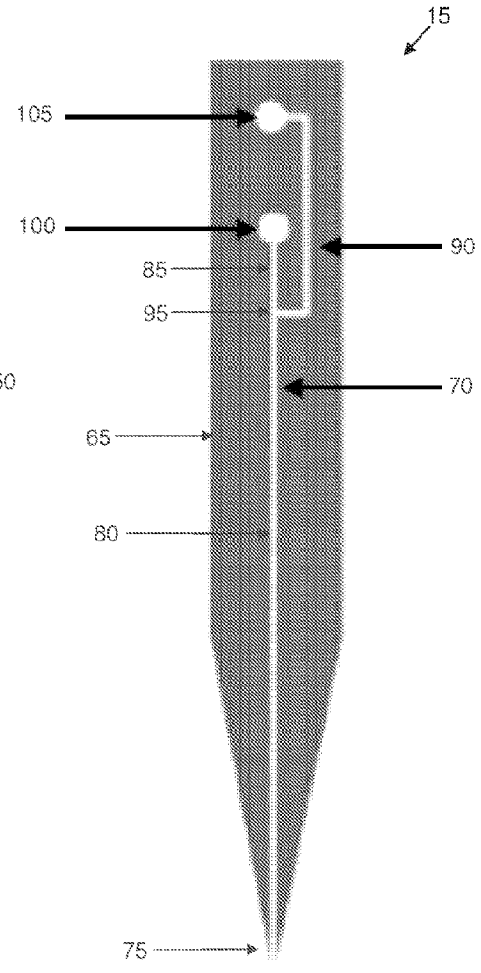
FIGS. 4 and 5 are schematic views showing details of the single-cell pipette tip of the novel single-cell pipette assembly of FIG. 1, including the single-cell trap disposed within the single-cell pipette tip.
Figure 3:
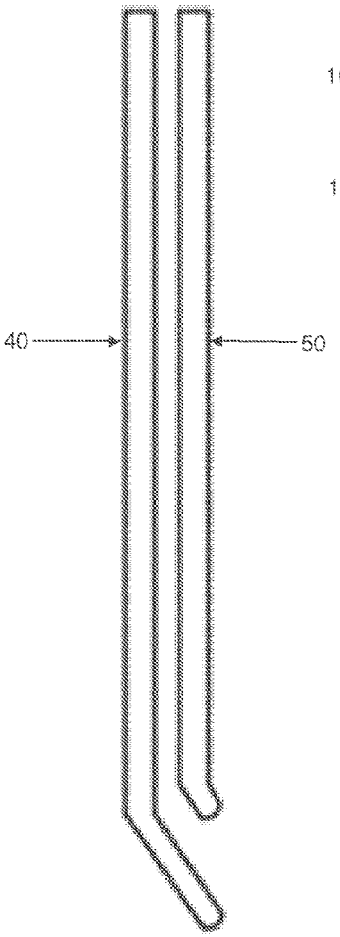
FIG. 3 is a schematic view showing connection tubes for connecting the single-cell pipette handle of the novel single-cell pipette assembly of FIG. 1 to the single-cell pipette tip of the novel single-cell pipette assembly of FIG. 1.
Figure 2:
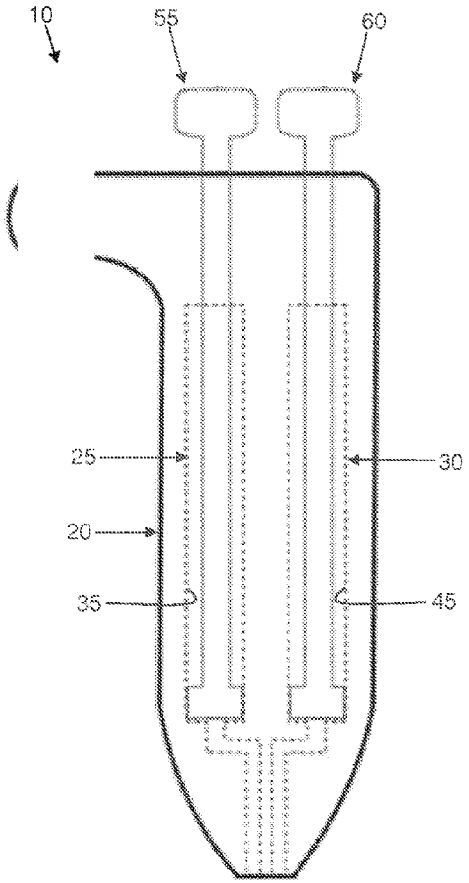
FIG. 2 is a schematic view showing the single-cell pipette handle of the novel single-cell pipette assembly of FIG. 1.
Figure 5:
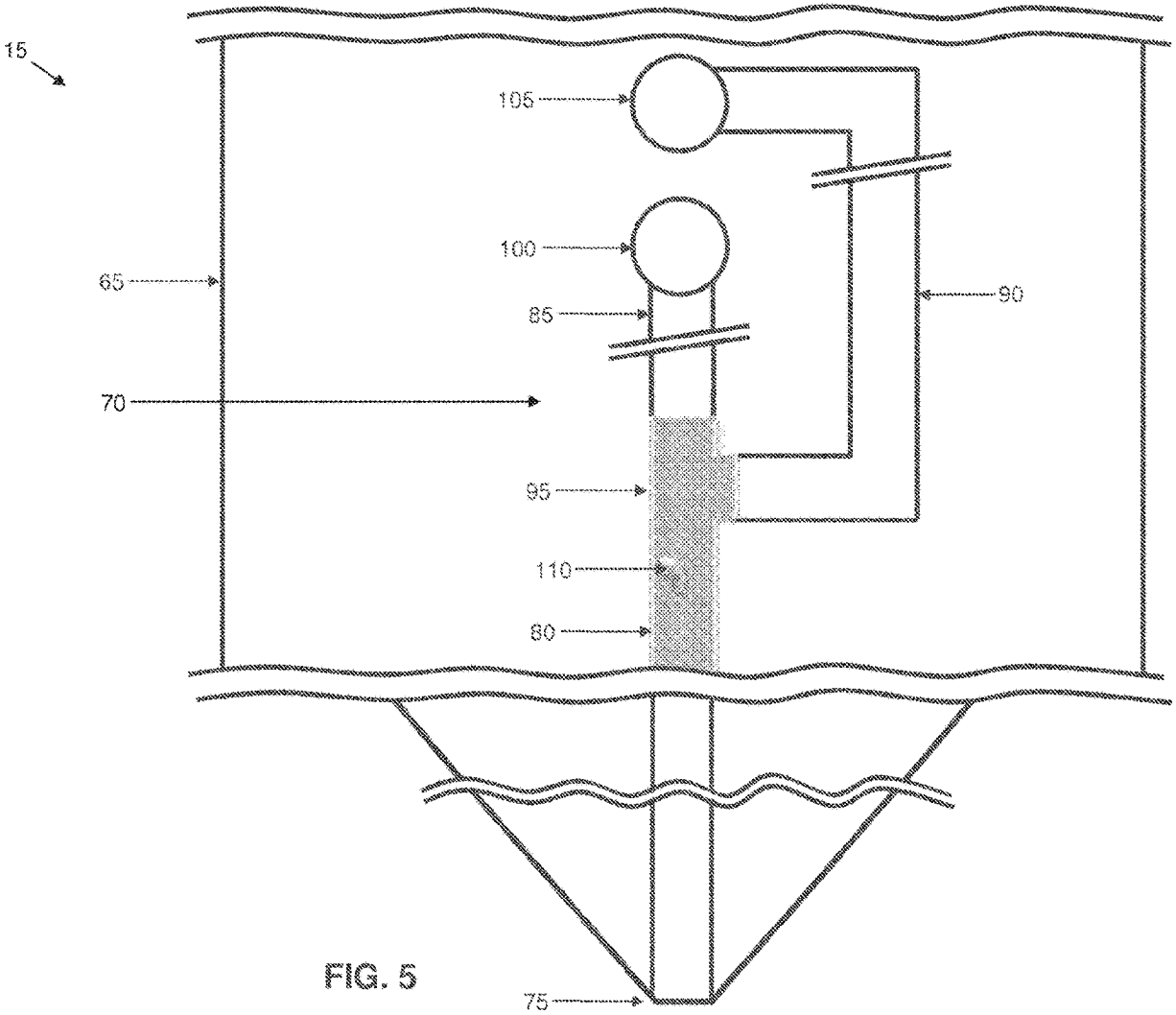
Figure 8:
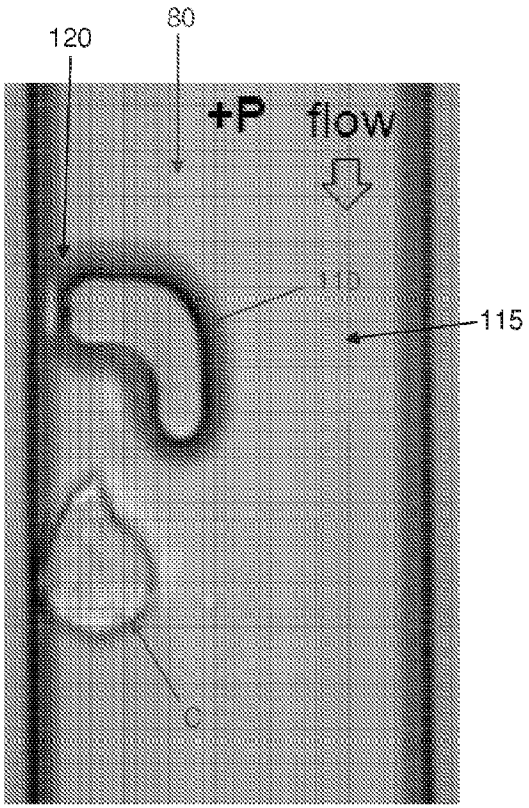
FIGS. 6-8 are schematic views showing further details of the single-cell trap shown in FIG. 5, including showing the single-cell trap holding a captured cell and releasing the captured cell.
Figure 7:
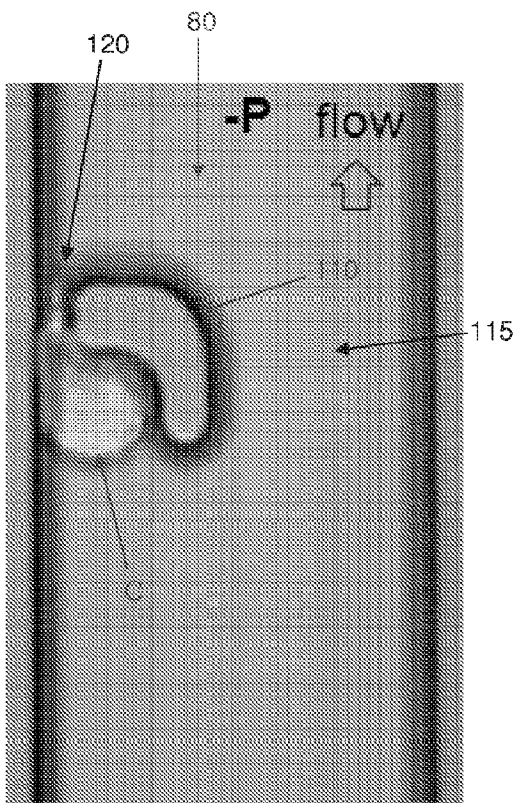
Figure 6:
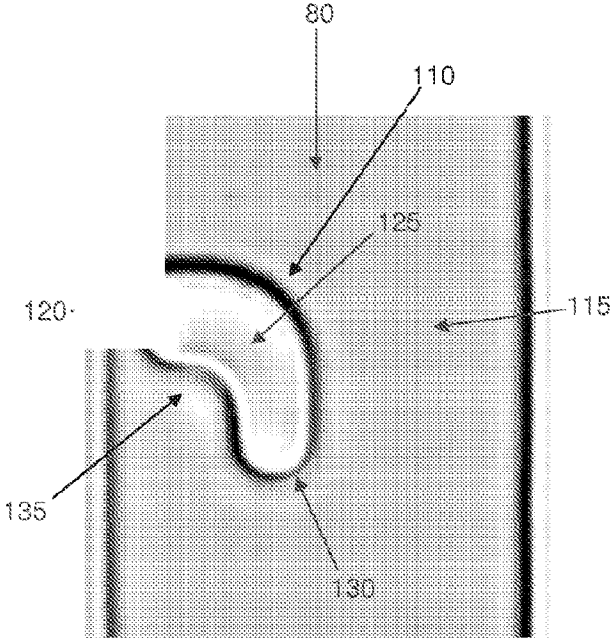
Figure 9D:
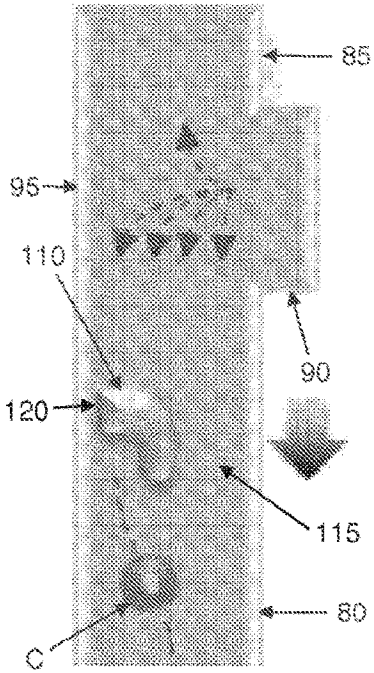
FIGS. 9A-9D are schematic views showing how a slurry of cells may be flowed by the single-cell trap of the single-cell pipette tip, an individual cell captured in the single-cell trap, and the individual cell thereafter released from the single-cell trap.
Figure 9C:
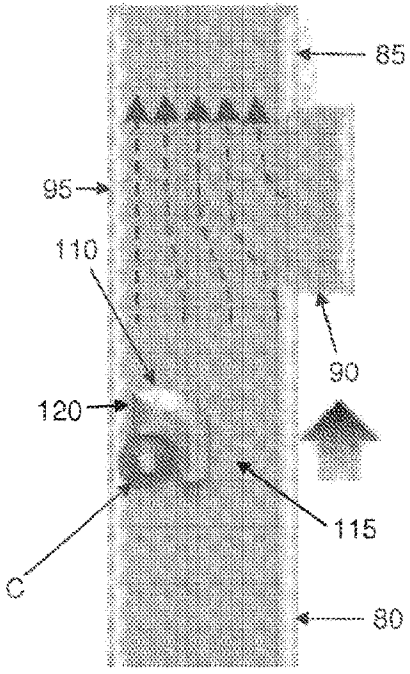
Figure 9B:
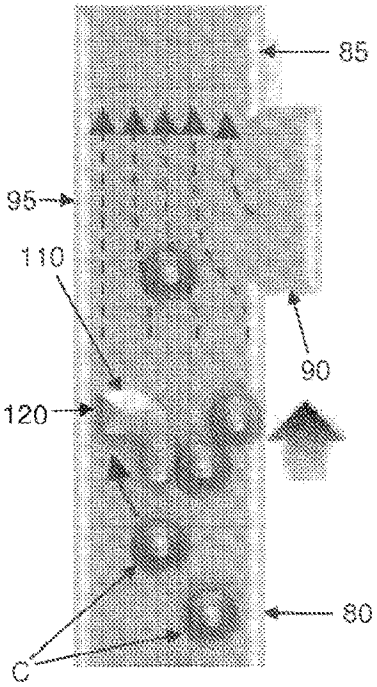
Figure 9A:
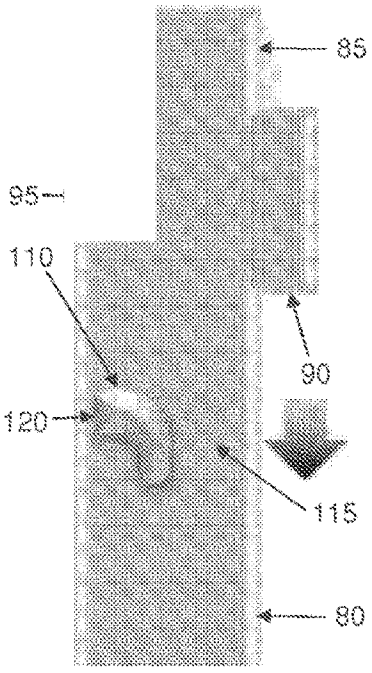

The present invention provides a new approach for isolating an individual cell from a group of cells and transferring that isolated cell to a desired location.

More particularly, the present invention comprises the provision and use of a novel single-cell pipette assembly for isolating an individual cell from a group of cells and transferring that isolated cell to a desired location.

In one preferred form of the invention, and looking now at FIGS. 1-5, there is provided a single-cell pipette assembly 5. Single-cell pipette assembly 5 comprises a single-cell pipette handle 10 and a single-cell pipette tip 15. Single-cell pipette handle 10 and single-cell pipette tip 15 are preferably formed as separate elements which are assembled by the user prior to use, although they may also be formed as a single integral member if desired. For purposes of the present invention, single-cell pipette handle 10 and single-cell pipette tip 15 will be discussed in the context of being formed as separate elements which are assembled by the user prior to use.

Single-cell pipette handle 10 comprises a body 20, a first pressure channel 25 and a second pressure channel 30. In one preferred form of the invention, first pressure channel 25 comprises a first passageway 35 extending through body 20 and communicating with a first connection tube 40; and second pressure channel 30 comprises a second passageway 45 extending through body 20 and communicating with a second connection tube 50. In one preferred form of the invention, a first plunger 55 is movably disposed in first passageway 35, such that movement of first plunger 55 in first passageway 35 can apply positive or negative pressure to first connection tube 40; and a second plunger 60 is movably disposed in second passageway 45, such that movement of second plunger 60 in second passageway 45 can apply positive or negative pressure to second connection tube 50. It should be appreciated that, if desired, single-cell pipette handle 10 may comprise a traditional Air Displacement Pipette (ADP) of the sort well known in the art for providing a negative pressure channel (e.g., first pressure channel 25) operated by moving a first mechanism (e.g., first plunger 55), and a positive pressure channel (e.g., second pressure channel 30) operated by moving a second mechanism (e.g., second plunger 60). It should also be appreciated that first connection tube 40 and second connection tube 50 are preferably detachable from body 20 of single-cell pipette handle 10, such that first connection tube 40 and second connection tube 50 may be discarded after use (or appropriately cleaned and sterilized for subsequent reuse if desired).

Single-cell pipette tip 15 comprises a body 65 having a Y-shaped microchannel 70 formed therein. Body 65 has a distal tip 75. Y-shaped microchannel 70 comprises a base microchannel 80, a first branch microchannel 85 and a second branch microchannel 90, with base microchannel 80, first branch microchannel 85 and second branch microchannel 90 converging at a convergence point 95. Base microchannel 80 extends from convergence point 95 to distal tip 75. First branch microchannel 85 extends from convergence point 95 to a first coupling 100, where first branch microchannel 85 connects to first connection tube 40. Second branch microchannel 90 extends from convergence point 95 to a second coupling 105, where second branch microchannel 90 connects to second connection tube 50.

A single-cell trap 110 is disposed in base microchannel 80, distal to convergence point 95. As will hereinafter be discussed, single-cell trap 110 allows a single cell to be captured, and thereby isolated, from a group of cells, and thereafter selectively released, for transfer to a desired location.

More particularly, and looking now at FIGS. 5-8, single-cell trap 110 is disposed as "an island" in base microchannel 80, whereby to divide the base microchannel into a wide path 115 and a narrow path 120. Wide path 115 is sized so as to be able to pass cells and fluid therethrough. Narrow path 120 is sized so as to pass only fluid therethrough. Single-cell trap 110 comprises a body 125 comprising a flow diverter 130 and a well 135. Flow diverter 130 is spaced from the side wall of base microchannel 80 and diverts the flow passing by single-cell trap 110 into either wide path 115 or narrow path 120. Well 135 is disposed on the distal side of body 125, outboard of flow diverter 130 (and proximal to the distalmost portion of flow diverter 130) and, together with flow diverter 130 and the side wall of base microchannel 80, provides a seat for one individual cell.

In one preferred form of the invention, single-cell pipette tip 15 may have a length of 5 mm and a distal tip width of 300 μm. Base microchannel 80 may have a width of 40 μm, wide path 115 may have a width of 22 μm, narrow path 120 may have a width of 3 μm, flow diverter 130 may have a width of 6 μm and well 135 may have a width of 12 μm and a depth of 10 μm.

Single-cell pipette tip 15 is preferably provided by first designing the single-cell pipette tip with CAD software and then fabricating the single-cell pipette tip using photolithography and polydimethylsiloxane (PDMS) molding techniques.

On account of the foregoing construction, and looking now at FIGS. 9A-9D, when a slurry of cells C passes proximally through base microchannel 80 (i.e., from distal tip 75 toward convergence point 95), flow diverter 130 causes some of the flow to pass down wide path 115 and some of the flow to pass down narrow path 120. Significantly, as the cells C in the slurry encounter flow diverter 130 of single-cell trap 110, most of the cells C follow wide path 115 and pass by single-cell trap 110. See FIGS. 9A and 9B. However, in some instances, a single cell C will be diverted into well 135 of single-cell trap 110. See FIG. 9C. Note that cells C may cluster in wide path 115 adjacent to flow diverter 130 as they try to move through wide path 115, and this clustering of cells may assist in a single cell being diverted into well 135. Thereafter, and looking now at FIG. 9D, the captured cell C may be selectively released from single-cell trap 110 (e.g., for transfer to a desired location) by flowing fluid distally through base microchannel 80 (i.e., by flowing fluid from convergence point 95 to distal tip 75).

Note that there are two potential flow paths around single-cell trap 110: the capture path (i.e., narrow path 120) and the bypass path (i.e., wide path 115). Flow profile simulations show that the flow rate along the bypass path (i.e., wide path 115) is much larger than the flow rate along the capture path (i.e., narrow path 120), indicating that single cells prefer to flow along the bypass path rather than along the capture path, thereby generally resulting in a failed capture. It has been found that single cell capture can only occur occasionally when the cell concentration is lower than about $10^5$ cells/ml. However, when the cell concentration is higher than about $10^6$ cells/ml, single cell capture can occur much more often as the bypass path (i.e., wide path 115) is frequently occupied by other cells at this concentration level. In other words, at this higher concentration level, it is more likely that the cells may cluster in the bypass path (i.e., wide path 115) as the cells try to move through the bypass path (i.e., wide path 115), and this clustering of cells may assist in a single cell being diverted into well 135 of single-cell trap 110.

Figure 10:
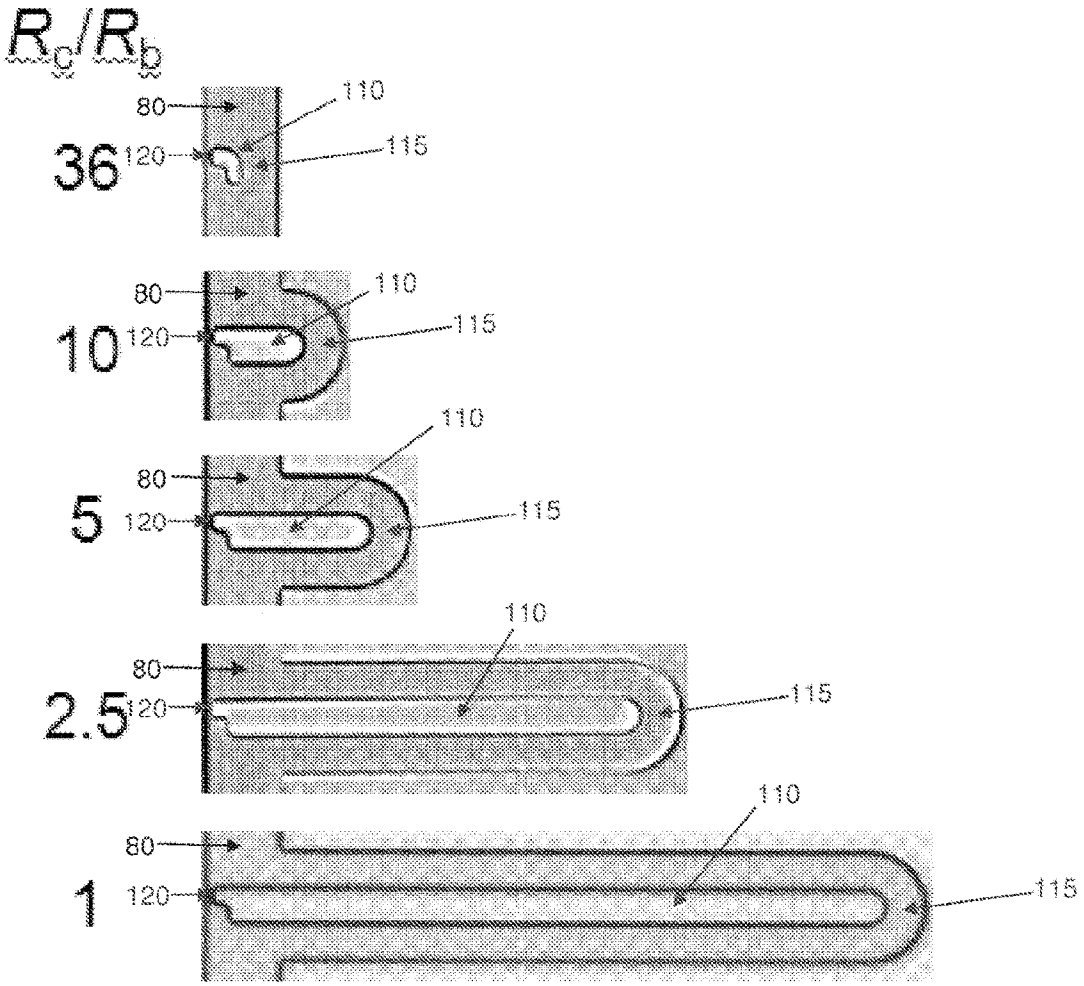
FIG. 10 is a schematic view showing various ways in which the base microchannel of the single-cell pipette tip may be configured to facilitate capture of a single cell by the single-cell trap.

A variety of factors have been identified which can affect single cell capture efficiency, including fluid resistance ratios, aspiration times, and cell concentrations. Experimental results reveal that the highest capture efficiency is achieved when the width of the bypass path (i.e., wide path 115) is approximately 1.67 times larger than the diameter of the cell to be captured. A decrease in the ratio of fluid resistance along the capture path ($R_c$) to the fluid resistance along the bypass path ($R_b$) can also increase the probability of single cell capture by the single-cell trap 110. In other words, and looking now at FIG. 10, by increasing the length of wide path 115 relative to narrow path 120, whereby to increase the fluid resistance $R_b$ of wide path 115 relative to the fluid resistance $R_c$ of narrow path 120, the probability of single cell capture can be increased.

It has also been found that longer aspiration times are beneficial to improving single cell capture efficiency.

Single cell capture efficiency can reach up to 96.7% where the ratio of the fluid resistance along the capture path to the fluid resistance along the bypass path ($R_c/R_b$) is 36, the aspiration time is 5 seconds, and the cell suspension has a concentration of $10^7$/mL.

Figure 10A:
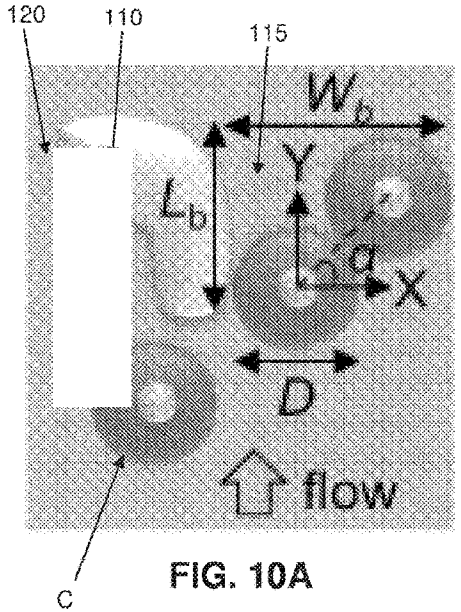
FIG. 10A is a schematic view showing a simple model of single-cell capture by the single-cell trap.
Figure 10B:
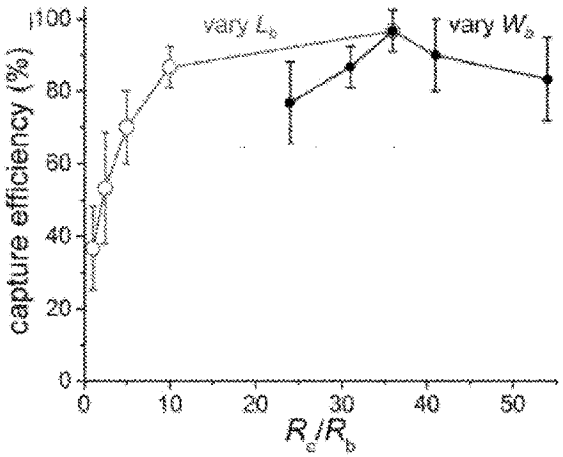
FIG. 10B is a graph showing single-cell capture efficiency under various fluid-resistance rations $R_c/R_b$.
Figure 10C:
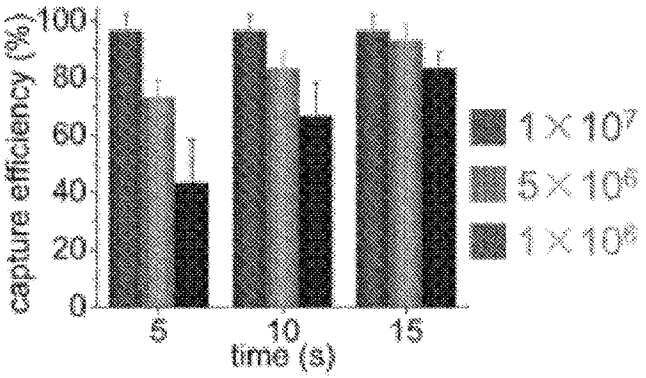
FIG. 10C is a graph showing single-cell capture efficiency under various aspiration times and cell concentrations.
Figures 11, 12, 13:
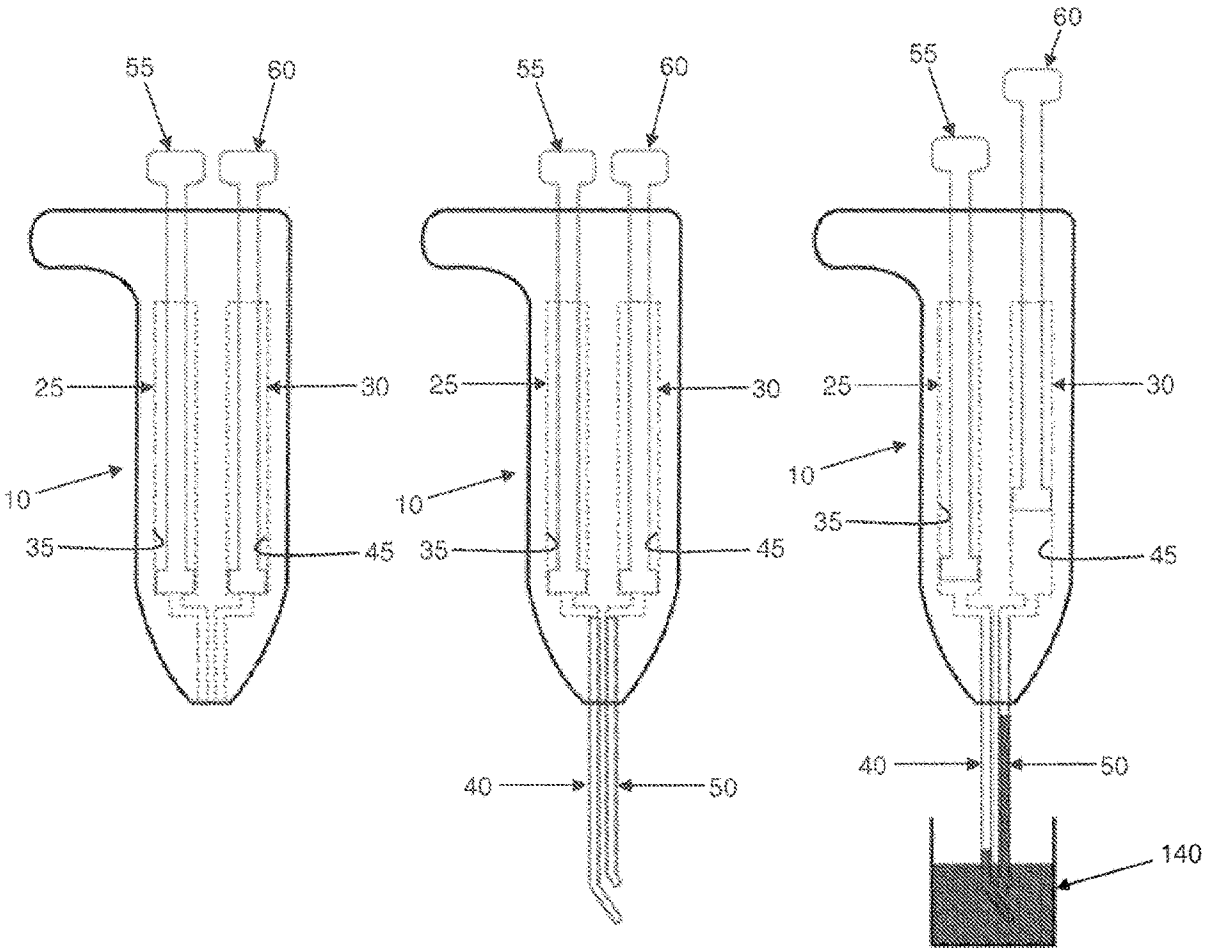
FIGS. 11-19 are schematic views showing how the novel single-cell pipette assembly of FIG. 1 may be used to isolate an individual cell from a group of cells and transfer that isolated cell to a desired location.
Figures 14, 15, 16:
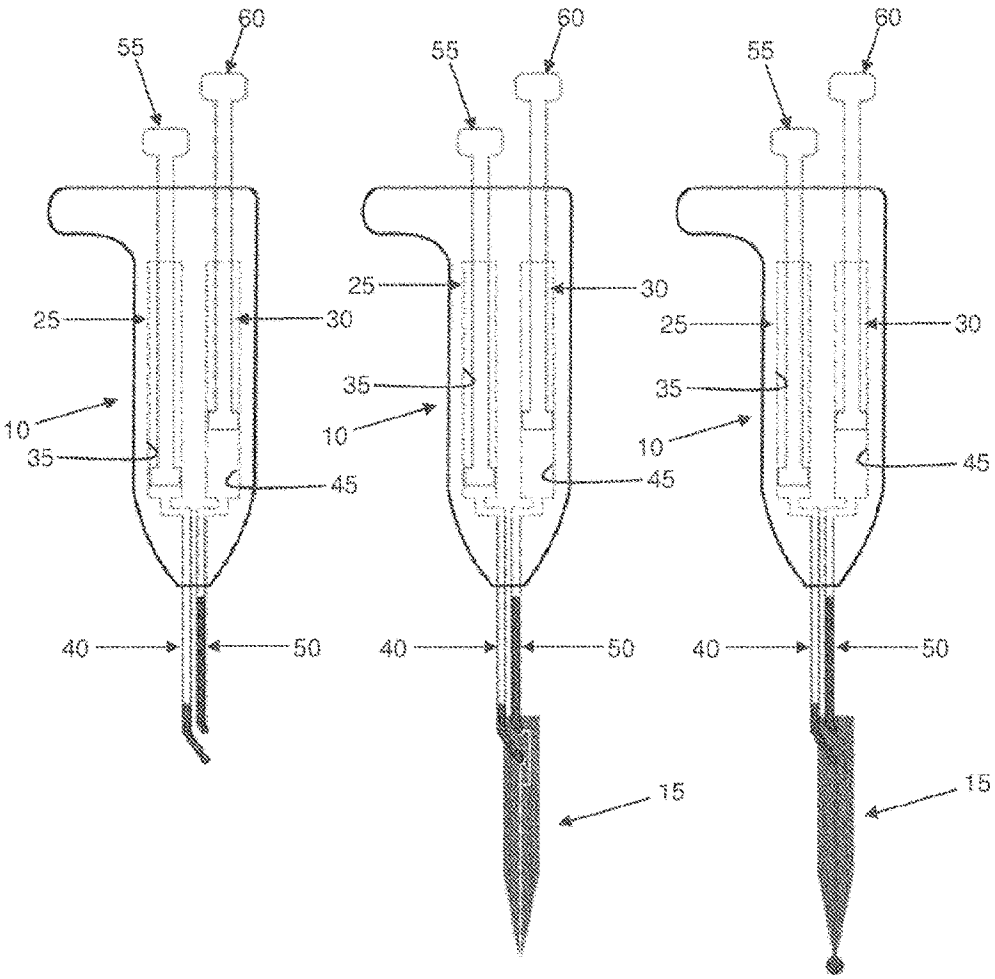
Figures 17, 18, 19:
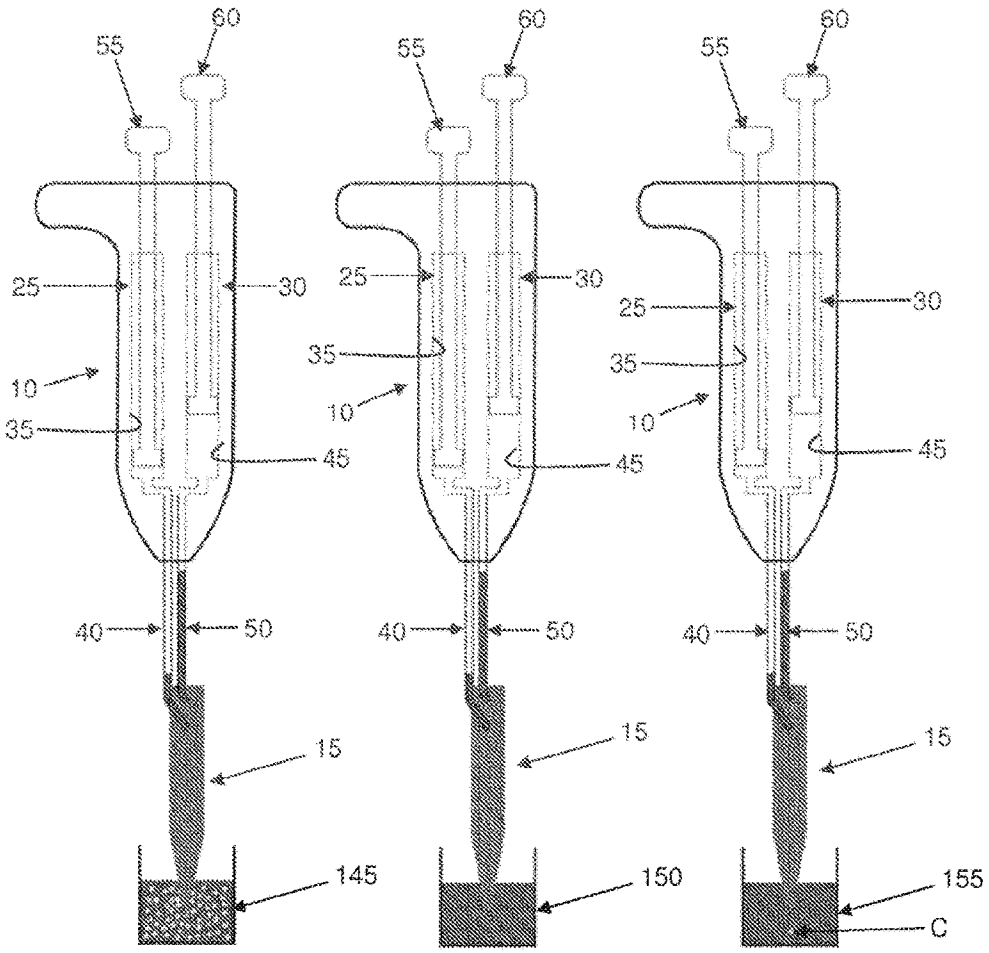
Figure 22:
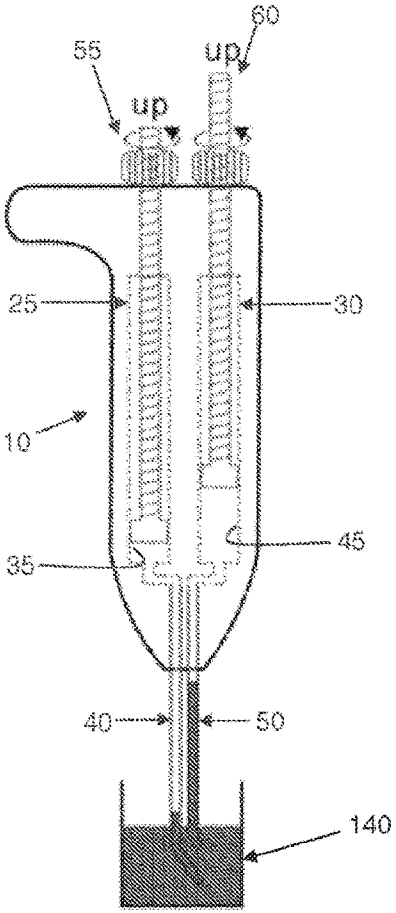
FIGS. 20-28 are schematic views similar to those of FIGS. 11-19, except showing a modified form of single-cell pipette assembly isolating an individual cell from a group of cells and transferring that isolated cell to a desired location.
Figure 21:
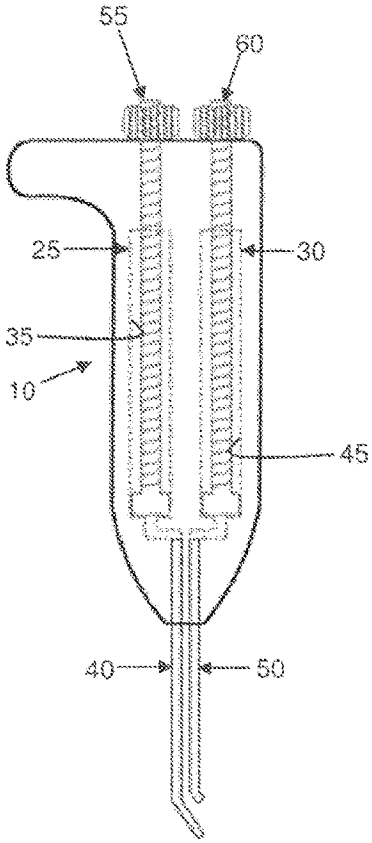
Figure 20:
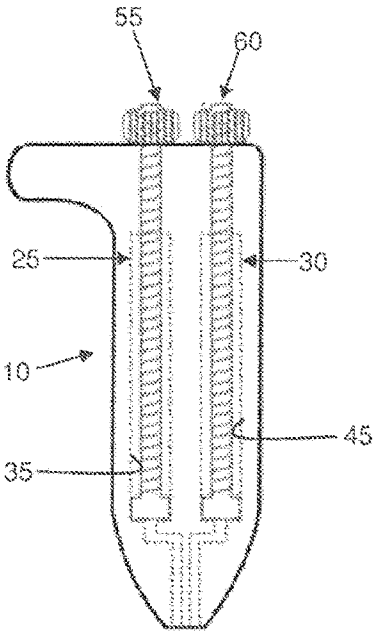
Figures 23, 24, 25:
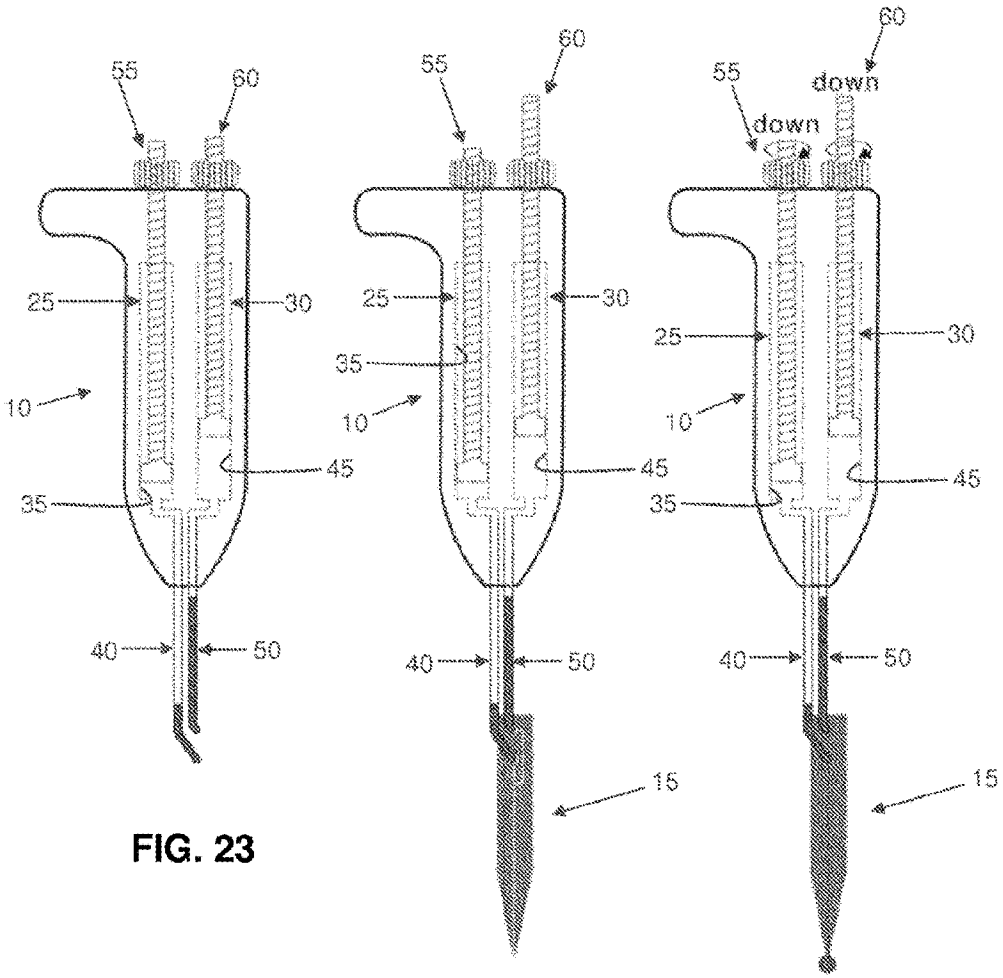
Figures 26, 27, 28:
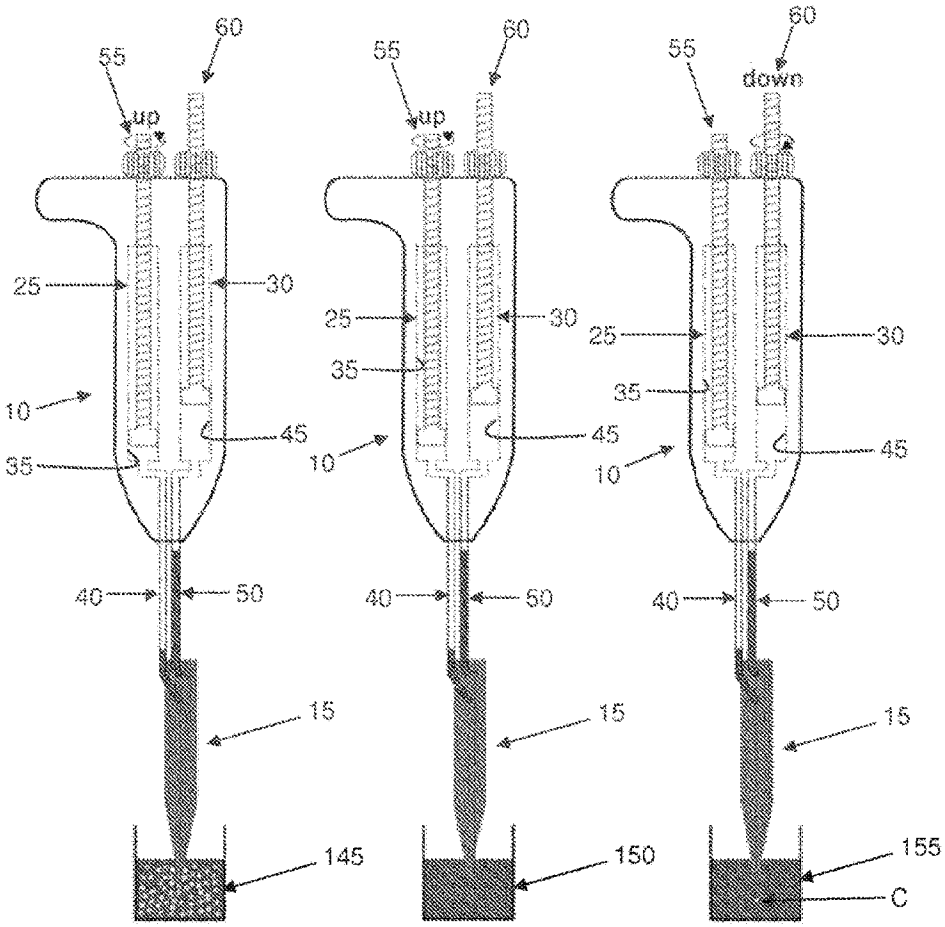

By way of further example but not limitation, FIG. 10A shows a simple model of single-cell capture by the single-cell trap 110; FIG. 10B shows single-cell capture efficiency under various fluid-resistance rations $R_c/R_b$; FIG. 10C shows single-cell capture efficiency under various aspiration times and cell concentrations; FIG. 10D shows single-cell capture efficiency with various bypass path widths; and FIG. 10E shows single-cell capture efficiency with various bypass path lengths.

FIGS. 11-19 show how novel single-cell pipette assembly 5 may be used to isolate an individual cell from a group of cells and transfer that isolated cell to a desired location.

More particularly, in one preferred method of use, first connection tube 40 and second connection tube 50 are first mounted to body 20 of single-cell pipette handle 10, if they are not already mounted to body 20, so that first connection tube 40 is in fluid communication with first pressure channel 25 and second connection tube 50 is in fluid communication with second pressure channel 30. See FIGS. 11 and 12. It will be appreciated that when first connection tube 40 is in fluid communication with first pressure channel 25 and second connection tube 50 is in fluid communication with second pressure channel 30, first connection tube 40 effectively constitutes an extension of first pressure channel 25 and second connection tube 50 effectively constitutes an extension of second pressure channel 30.

Then first connection tube 40 and second connection tube 50 are primed with primer solution, i.e., by positioning the distal ends of first connection tube 40 and second connection tube 50 in primer solution 140, and then retracting first plunger 55 within first passageway 35 and second plunger 60 within second passageway 45. See FIG. 13. Note that the primer fluid is not pulled into either first passageway 35 or second passageway 45 of body 20 of single-cell pipette handle 10. As a result, first passageway 35 and second passageway 45 of body 20 of single-cell pipette handle 10 are uncontaminated. Then the distal ends of first connection tube 40 and second connection tube 50 are withdrawn from primer solution 140. See FIG. 14.

Next, single-cell pipette tip 15 is mounted to single-cell pipette handle 10 by connecting first connection tube 40 to first coupling 100 of single-cell pipette tip 15 and by connecting second connection tube 50 to second coupling 105 of single-cell pipette tip 15. See FIG. 15. Then, Y-shaped microchannel 70 in single-cell pipette tip 15 is primed using the primer solution in first connection tube 40 and second connection tube 50, i.e., by advancing first plunger 55 within first passageway 35 and second plunger 60 within second passageway 45. See FIG. 16. Preferably first plunger 55 is advanced sufficiently within first passageway 35 so as to eject at least some primer solution out of the distal end of single-cell pipette tip 15, and second plunger 60 is advanced sufficiently within second passageway 45 so as to eject at least some primer solution out of the distal end of single-cell pipette tip 15, whereby to ensure that Y-shaped microchannel 70 is completely filled with primer solution.

Next, distal tip 75 of single-cell pipette 15 is disposed in a slurry of cells 145, and negative pressure is applied to first pressure channel 25, i.e., by withdrawing first plunger 55 within first passageway 35, whereby to draw the slurry of cells proximally up into base microchannel 80 and into first branch microchannel 85. See FIG. 17. This action causes a single cell from the slurry to be captured in single-cell trap 110, e.g., in the manner shown in FIGS. 9A-9C. Note that neither primer fluid 140 nor slurry of cells 145 is/are pulled into either first passageway 35 or second passageway 45 of body 20 of single-cell pipette handle 10. As a result, first passageway 35 and second passageway 45 of body 20 of single-cell pipette handle 10 remain uncontaminated. Then distal tip 75 of single-cell pipette 15 is withdrawn from the slurry of cells 145 and is positioned in a wash solution 150. Negative pressure is applied to first pressure channel 25, i.e., by withdrawing first plunger 55 within first passageway 45, so that the wash solution flushes the slurry of cells out of base microchannel 80, with the captured cell remaining in single-cell trap 110. See FIG. 18. Again, note that neither primer fluid 140 nor slurry of cells 145 nor wash solution 150 is/are pulled into either first passageway 35 or second passageway 45 of body 20 of single-cell pipette handle 10. As a result, first passageway 35 and second passageway 45 of body 20 of single-cell pipette handle 10 remain uncontaminated.

Thereafter, when the single cell captured in single-cell trap 110 is to be transferred to a desired location, positive pressure is applied to second pressure channel 30, i.e., by advancing second plunger 60 distally through second passageway 45, so that the primer solution in second connection tube 50 is flushed through second branch microchannel 90, into base microchannel 80 and then out distal tip 75 of single-cell pipette tip 15, whereby to flush the captured cell out of single-cell trap 110 (e.g., in the manner shown in FIG. 9D) and hence out distal tip 75 of single-cell pipette tip 15 and into (or onto) an appropriate receptacle (or support) 155 (e.g., a common 96- or 384-well plate, a cell culture dish, a vial, a microscope slide, etc.).

The entire process can be completed within 10 seconds.

Thus it will be seen that single-cell pipette assembly 5 may be used to obtain single cells directly from a cell suspension. Single-cell pipette assembly 5 is characterized by operational simplicity, high efficiency and low cost.

Significantly, single-cell pipette assembly 5 does not harm the individual cell captured by single-cell trap 110, so that single-cell pipette assembly 5 can be used for live single cell isolation and transfer.

Also significantly, with the present invention, single cell isolation and transfer is effected using an operation which is generally similar to the operation used to transfer liquid with an Air Displacement Pipette (ADP), thereby greatly minimizing operational training and cost.

Single-cell pipette assembly 5 may be used to isolate and transfer additional individual cells by repeating the foregoing process. In this respect it should be appreciated that, where it is desirable to avoid cross-contamination between cell samples, first connection tube 40, second connection tube 50 and single-cell pipette tip 15 may be dismounted from body 20 of single-cell pipette handle 10 and replaced. Note that inasmuch as primer solution 140, slurry of cells 145 and wash solution 150 is/are never drawn up into first passageway 35 or second passageway 45 of body 20 of single-cell pipette handle 10, first passageway 35 and second passageway 45 of body 20 of single-cell pipette handle 10 remain uncontaminated. Thus, replacing first connection tube 40, second connection tube 50 and single-cell pipette tip 15 between cell samples prevents cross-contamination even though the same single-cell pipette handle 10 may be reused.

The single-cell pipette assembly 5 shown in FIGS. 1-19 comprises first plunger 55 and second plunger 60 for applying positive or negative pressure to first pressure channel 25 and second pressure channel 30, respectively. However, if desired, other means may be provided for applying positive or negative pressure to first pressure channel 25 and second pressure channel 30, respectively. By way of example but not limitation, and looking now at FIGS. 20-28, a first screw drive 55 and a second screw drive 60 may be provided for applying positive or negative pressure to first pressure channel 25 and second pressure channel 30, respectively.

If desired, single-cell pipette handle 10 may be replaced by alternative pressure-applying/vacuum-applying apparatus comprising a first pressure channel capable of applying positive and negative pressure to first coupling 100 of single-cell pipette tip 15, and a second pressure channel capable of applying positive and negative pressure to second coupling 105 of cell pipette tip 15, e.g., an appropriate multi-channel pressure/vacuum source.

Figure 28A:
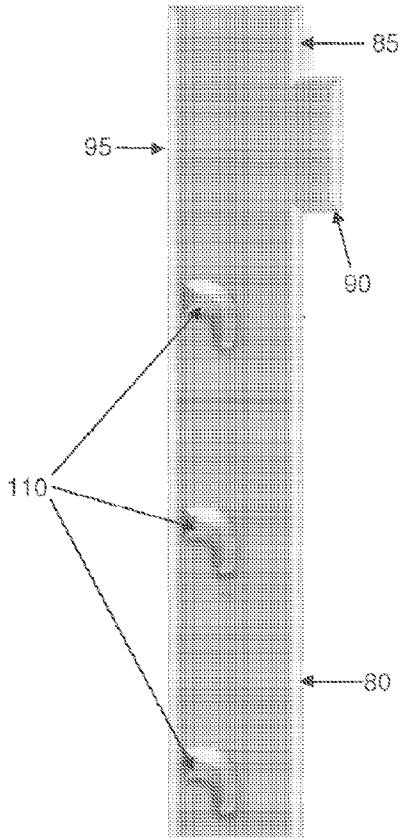
FIG. 28A is a schematic view showing another novel form of single-cell pipette assembly, wherein the single-cell pipette tip comprises multiple single-cell traps.

In another form of the invention, single-cell pipette assembly 5 can be configured to isolate and transfer more than one cell with each cycle of the single-cell pipette assembly. More particularly, where it is desired to transfer N cells with each cycle of single-cell pipette assembly 5, N single-cell traps 110 are positioned in base microchannel 80 of single-cell pipette tip 15. As a result, with each cycle of single-cell pipette assembly 5, N cells are captured and transferred. See FIG. 28A.

Furthermore, if desired, single-cell pipette assembly 5 may be configured to mount multiple single-cell pipette tips 15 to single-cell pipette handle 10, so that single-cell pipette assembly 5 may simultaneously capture, and then simultaneously transfer, a plurality of cells, with those cells being spatially separated from one another. In this situation, single-cell pipette handle 10 is configured to receive multiple pairs of first connection tube 40, second connection tube 50 and, for each pair of first connection tube 40, second connection tube 50, to connect first connection tube 40 to first pressure channel 25 and second connection tube 50 to second pressure channel 30, respectively. See FIGS. 29-32.

Figure 30:
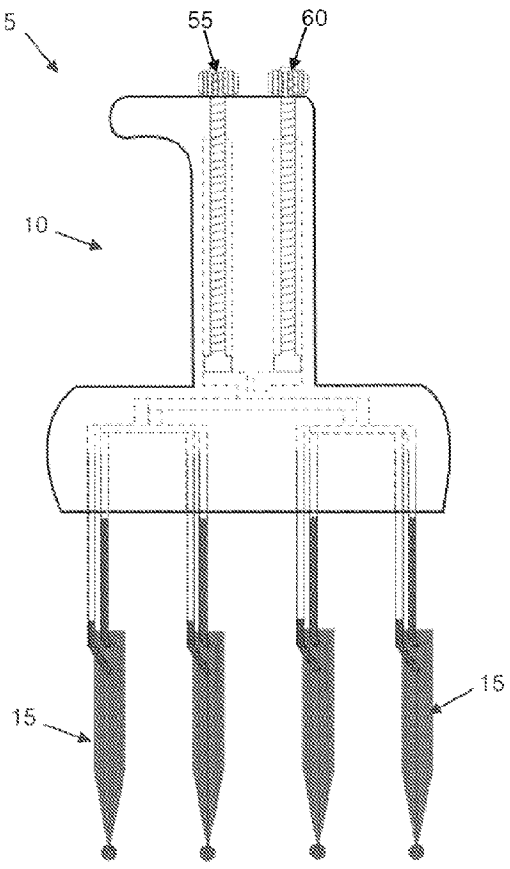
FIG. 30 is a schematic view similar to that of FIG. 29, except showing a modified form of single-cell pipette handle.
Figure 29:
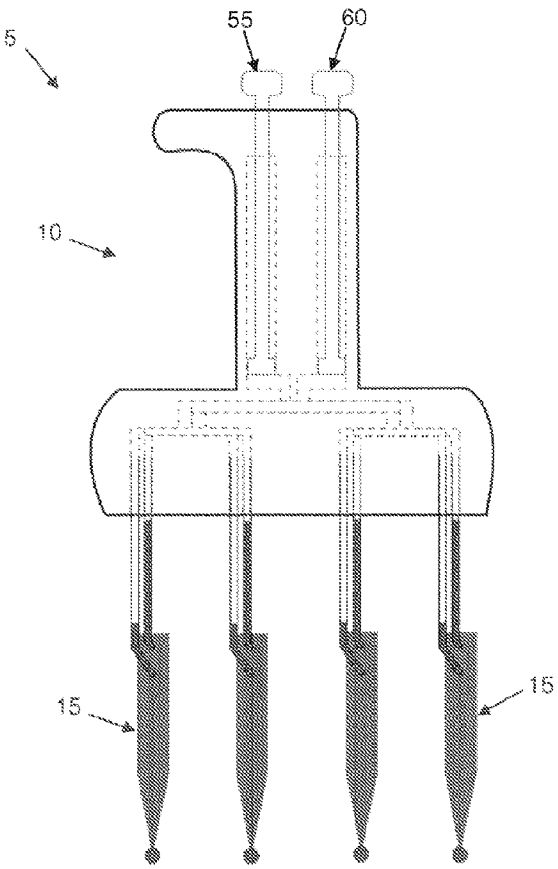
FIG. 29 is a schematic view showing another novel form of single-cell pipette assembly, wherein the single-cell pipette assembly comprises multiple single-cell pipette tips.
Figure 32:
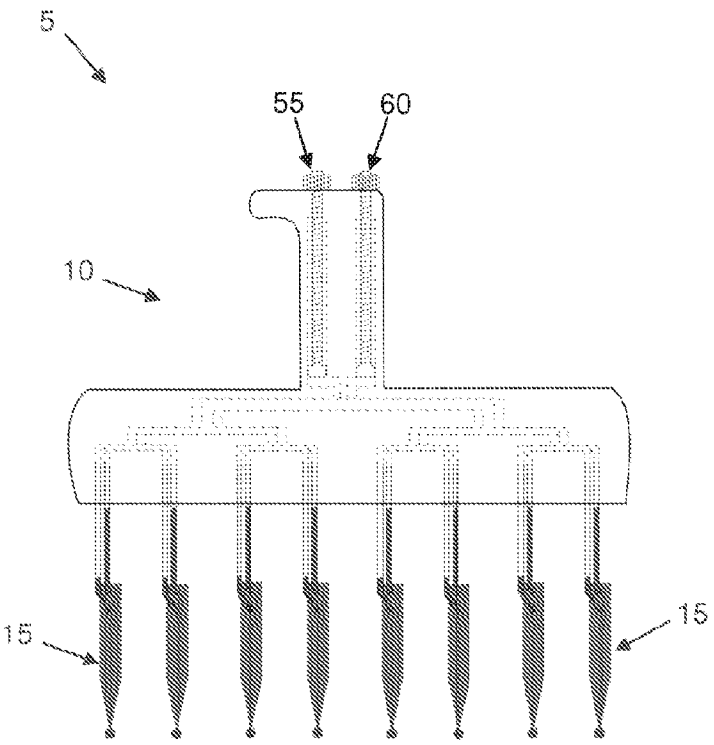
FIG. 32 is a schematic view similar to that of FIG. 31, except showing a modified form of single-cell pipette handle.
Figure 31:
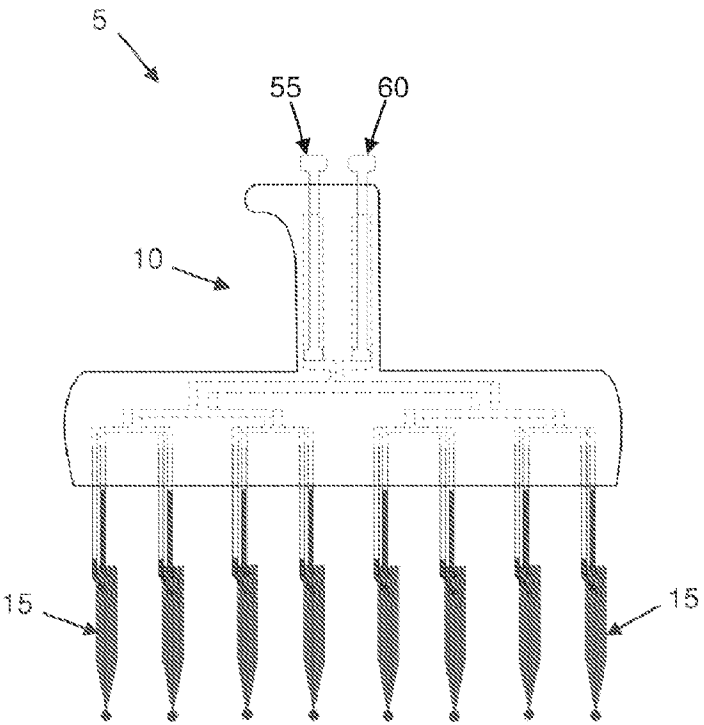
FIG. 31 is a schematic view showing another novel form of single-cell pipette assembly, wherein the single-cell pipette assembly comprises multiple single-cell pipette tips.

In FIGS. 29 and 30, single-cell pipette assembly 5 comprises four single-cell pipette tips 15 mounted to a single-cell pipette handle 10, with the single-cell pipette tips 15 being arranged in a linear configuration (when seen in end view); and in FIGS. 31 and 32, single-cell pipette assembly 5 comprises eight single-cell pipette tips 15 mounted to a single-cell pipette handle 10, with the single-cell pipette tips 15 being arranged in a linear configuration (when seen in end view).

It will be appreciated that more or less single-cell pipette tips 15 may be mounted to a single-cell pipette handle 10.

It will also be appreciated that the plurality of single-cell pipette tips 15 mounted to a single-cell pipette handle 10 may be arranged in configurations other than linear (when seen in end view). By way of example but not limitation, the plurality of single-cell pipette tips 15 (mounted to a single-cell pipette handle 10) may be arranged in a two dimensional matrix configuration (when seen in end view), e.g., an 8×12 matrix configuration, or a 16×24 matric configuration, etc. By way of further example but not limitation, the plurality of single-cell pipette tips 15 may be arranged in a circular configuration (when seen in end view).

If desired, the plurality of single-cell pipette tips 15 may be secured to one another, or formed integral with one another, so as to form a singular construction.

Figure 33:
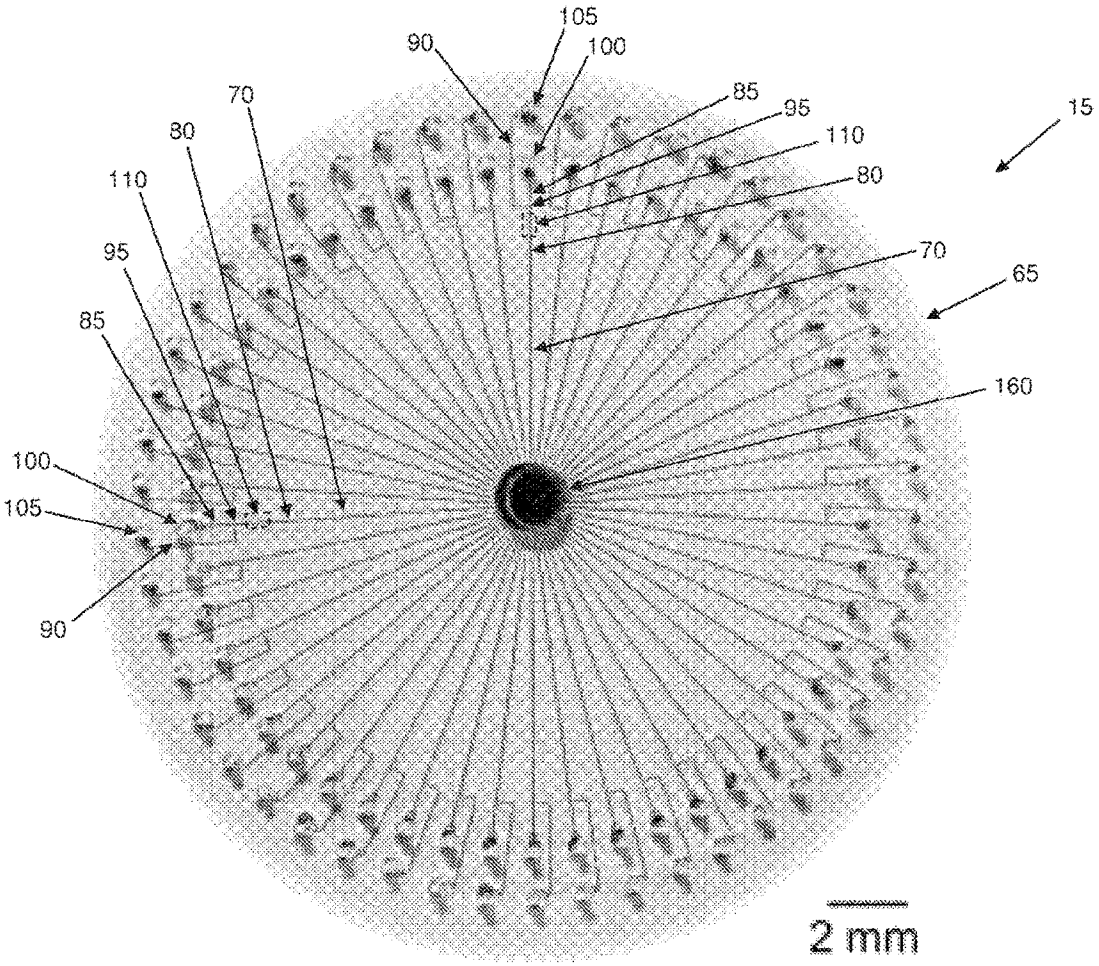
FIG. 33 is a schematic view showing another form of single-cell pipette tip formed in accordance with the present invention, wherein the body of the single-cell pipette tip comprises a plurality of Y-shaped microchannels each comprising a single-cell trap, and further wherein the plurality of Y-shaped microchannels share a common distal end inlet/outlet.

In still another preferred form of the present invention, and looking now at FIG. 33, there is provided a single-cell pipette tip 15 comprising a body 65 having a plurality of Y-shaped microchannels 70 formed therein, wherein the plurality of Y-shaped microchannels 70 share a common distal end inlet/outlet. More particularly, in this form of the invention, body 65 has a center opening 160 leading to a distal tip (not shown in FIG. 33 but analogous to the distal tip 75 shown in FIGS. 4 and 5). As discussed above, each Y-shaped microchannel 70 comprises a base microchannel 80, a first branch microchannel 85 and a second branch microchannel 90, with base microchannel 80, first branch microchannel 85 and second branch microchannel 90 converging at a convergence point 95. Base microchannel 80 extends from convergence point 95 to center opening 160 and then to distal tip 75. First branch microchannel 85 extends from convergence point 95 to a first coupling 100, which is configured for connection to first pressure channel 25 of a single-cell pipette handle 10 (or to another first pressure channel providing a positive/negative pressure source). Second branch microchannel 90 extends from convergence point 95 to a second coupling 105, which is configured for connection to second pressure channel 30 of a single-cell pipette handle 10 (or to another second pressure channel providing a positive/negative pressure source). Again, a single-cell trap 110 (shown schematically in FIG. 33 for reasons of scale) is disposed in each base microchannel 80, distal to convergence point 95. As discussed above, each single-cell trap 110, working in conjunction with Y-shaped microchannel 70 and appropriate sources of positive/negative pressure operating in an appropriate manner (including sequence), allows a single cell to be captured, and thereby isolated, from a group of cells, and thereafter selectively released, for transfer to a desired location.

Thus it will be seen that the single-cell pipette tip 15 shown in FIG. 33 provides the equivalent of multiple single-cell pipette tips 15 mounted together as a singular construction but modified so as to share a common distal end inlet/outlet.

The single-cell pipette tip 15 shown in FIG. 33 can be highly advantageous since a single distal tip (not shown in FIG. 33 but analogous to distal tip 75 shown in FIGS. 4 and 5) and a single center opening 160 can be used as the distal end inlet/outlet for each of the Y-shaped microchannels 70 provided in single-cell pipette tip 15. Thus, if desired, the aforementioned priming step (with primer solution 140), single-cell capture step (with slurry of cells 145 and single-cell traps 110) and wash step (with wash solution 150) can be simultaneously effected for each of the Y-shaped microchannels 70 in body 65 of single-cell pipette tip 15 using a common source of primer solution 140, a common source of a slurry of cells 145 and/or a common source of a wash solution 150; and then the aforementioned cell-release step (by flushing with primer solution 140) can be individually effected for each of the Y-shaped microchannels 70 (i.e., by selectively applying positive pressure to each of the second couplings 105, one at a time).

Figure 34:
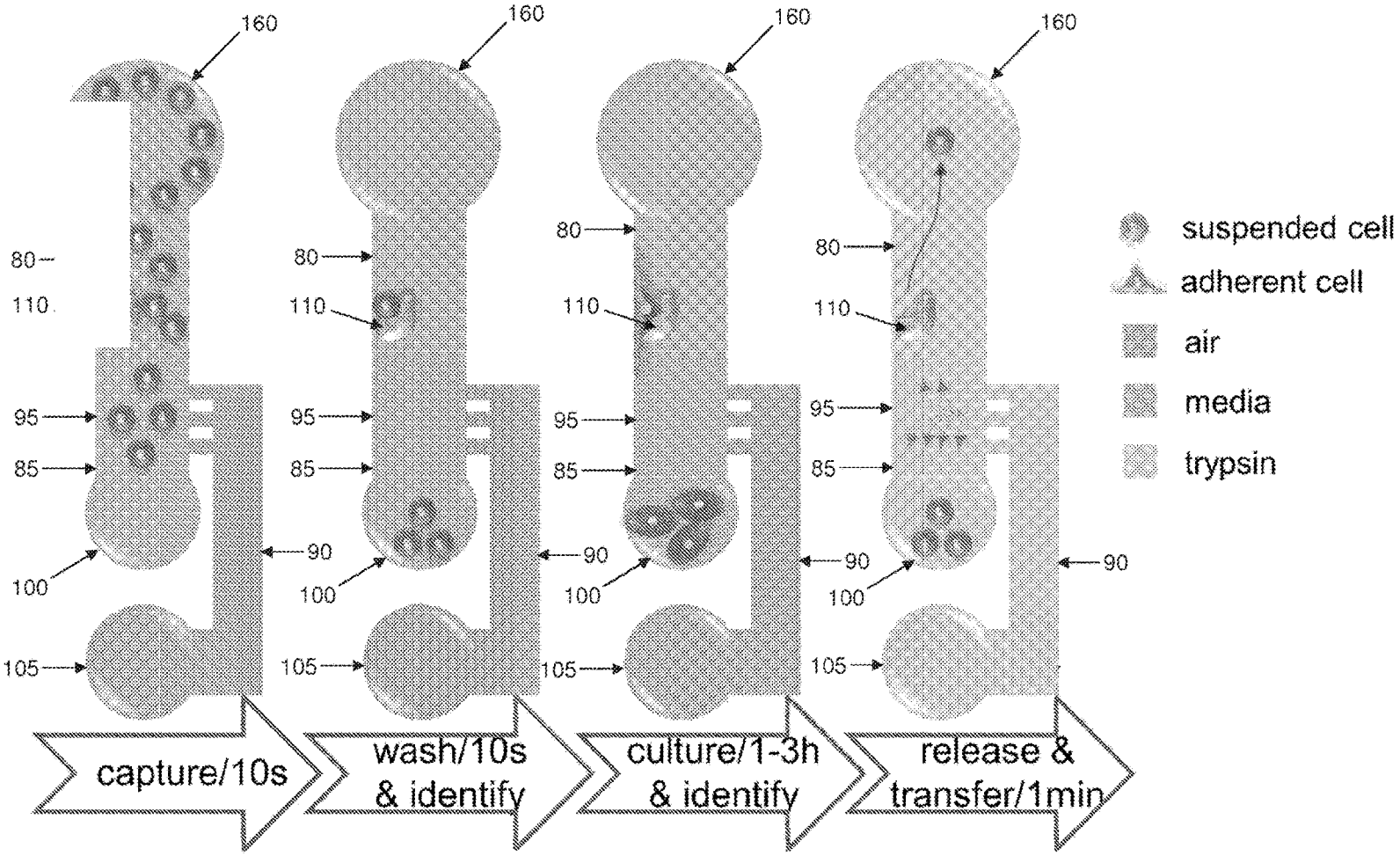
FIG. 34 is a schematic view showing how a cell captured in a single-cell trap of a Y-shaped microchannel may be cultured prior to release from the Y-shaped microchannel.

It is also possible to culture a cell after the cell has been captured in a single-cell trap 110 and before the cell is released from single-cell trap 110. By way of example but not limitation, with the single-cell pipette tip shown in FIG. 33, after an individual cell has been seated in a single-cell trap 110 of an individual Y-shaped microchannel 70, the cell may be cultured (e.g., for one to three hours) and thereafter released from the single-cell trap 110 of that Y-shaped microchannel. See FIG. 34. In this form of the invention, primer solution 140 may preferably comprise trypsin, since trypsin can facilitate the release of a cultured cell from single-cell trap 110.

Modifications of the Preferred Embodiments

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. Apparatus for isolating an individual cell from a group of cells and transferring that isolated cell to a desired location, said apparatus comprising:

a single-cell pipette tip, said single-cell pipette tip comprising:

a structure having a distal end;

a Y-shaped microchannel formed in said structure, said Y-shaped microchannel comprising a base microchannel, a first branch microchannel and a second branch microchannel, wherein said base microchannel extends to said distal end of said structure, said first branch microchannel is connectable to a first pressure channel, said second branch microchannel is connectable to a second pressure channel, and a single-cell trap is disposed in said base microchannel, distal to the convergence of said base microchannel with said first branch microchannel and said second branch microchannel.

2. Apparatus according to claim 1 wherein said single-cell trap comprises a body defining a flow diverter for diverting flow passing by said single-cell trap into a wide path or a narrow path, and said body and said structure together defining a well for capturing a cell diverted by said flow diverter toward said narrow path.

3. Apparatus according to claim 2 wherein said body of said single-cell trap is separated from said structure by a distance small enough to prevent a cell from passing therethrough.

4. Apparatus according to claim 2 wherein the width of said wide path is approximately 1.67 times larger than the diameter of the cell to be captured.

5. Apparatus according to claim 2 wherein the ratio of fluid resistance along said narrow path ($R_c$) to the fluid resistance along said wide path ($R_b$) is 36.

6. Apparatus according to claim 2 wherein said base microchannel comprises a plurality of single-cell traps, and further wherein said single-cell traps all have their diverters directed in a common direction.

7. Apparatus according to claim 1 further comprising a single-cell pipette handle comprising a first pressure channel connectable to said first branch microchannel of said single-cell pipette tip and a second pressure channel connectable to said second branch microchannel of said single-cell pipette tip.

8. Apparatus according to claim 7 wherein said single-cell pipette tip is separable from said single-cell pipette handle.

9. Apparatus according to claim 7 wherein said first pressure channel of said single-cell pipette handle is connected to said first branch microchannel of said single-cell pipette tip by a first connection tube, and said second pressure channel of said single-cell pipette handle is connected to said second branch microchannel of said single-cell pipette tip by a second connection tube.

10. Apparatus according to claim 9 wherein said first connection tube is detachably connected to said first pressure channel of said single-cell pipette handle and said first branch microchannel of said single-cell pipette tip, and said second connection tube is detachably connected to said second pressure channel of said single-cell pipette handle and said second branch microchannel of said single-cell pipette tip.

11. Apparatus according to claim 7 wherein said single-cell pipette tip is formed integral with said single-cell pipette handle.

12. Apparatus according to claim 1 comprising a plurality of structures mounted to one another so as to form a singular construction.

13. Apparatus according to claim 12 wherein said plurality of structures are secured to one another.

14. Apparatus according to claim 12 wherein said plurality of structures are formed integral with one another.

15. Apparatus according to claim 1 wherein said structure comprises a plurality of Y-shaped microchannels.

16. Apparatus according to claim 15 wherein each base microchannel of said plurality of Y-shaped microchannels terminates separately of every other base microchannel of said plurality of Y-shaped microchannels.

17. Apparatus according to claim 15 wherein each base microchannel of said plurality of Y-shaped microchannels terminates in a common distal end inlet/outlet with every other base microchannel of said plurality of Y-shaped microchannels.

18. A method for isolating an individual cell from a group of cells and transferring that isolated cell to a desired location, said method comprising:

providing a single-cell pipette tip, said single-cell pipette tip comprising:

a structure having a distal end;

a Y-shaped microchannel formed in said structure, said Y-shaped microchannel comprising a base microchannel, a first branch microchannel and a second branch microchannel, wherein said base microchannel extends to said distal end of said structure, said first branch microchannel is connectable to a first pressure channel, said second branch microchannel is connectable to a second pressure channel, and a single-cell trap is disposed in said base microchannel, distal to the convergence of said base microchannel with said first branch microchannel and said second branch microchannel;

priming said base microchannel, said first branch microchannel and said second branch microchannel with a primer solution;

positioning said base microchannel in a slurry of cells;

applying negative pressure to said first branch microchannel and said base microchannel so that the slurry of cells is drawn up into said base microchannel and into said first branch microchannel, with a single cell from the slurry being captured in said single-cell trap;

positioning said base microchannel in a wash solution;

applying negative pressure to said first branch microchannel and said base microchannel so that said wash solution flushes the slurry of cells out of said base microchannel, with the captured cell remaining in said single-cell trap; and thereafter, when the single cell captured in said single-cell trap is to be transferred to a desired location, applying positive pressure to said second pressure channel so that said primer solution is flushed through said second branch microchannel, into said base microchannel and then out said distal end of said single-cell pipette tip, whereby to flush the captured cell out of said single-cell trap, through said base microchannel and then out said distal end of the single-cell pipette tip.

19. A method according to claim 18 wherein said single-cell trap comprises a body defining a flow diverter for diverting flow passing by said single-cell trap into a wide path or a narrow path, and said body and said structure together defining a well for capturing a cell diverted by said flow diverter toward said narrow path.

20. A method according to claim 19 wherein said body of said single-cell trap is separated from said structure by a distance small enough to prevent a cell from passing therethrough.

21. A method according to claim 19 wherein the width of said wide path is approximately 1.67 times larger than the diameter of the cell to be captured.

22. A method according to claim 19 wherein the ratio of fluid resistance along said narrow path ($R_c$) to the fluid resistance along said wide path ($R_b$) is 36.

23. A method according to claim 19 wherein said suspension has a concentration of greater than $10^5$ cells/mL.

24. A method according to claim 23 wherein said suspension has a concentration of approximately $10^7$ cells/mL.

25. A method according to claim 19 wherein said slurry of cells is drawn up into said base microchannel and into said first branch microchannel over a period of approximately 5 seconds.

26. A method according to claim 19 wherein said base microchannel comprises a plurality of single-cell traps, and further wherein said single-cell traps all have their diverters directed in a common direction.

27. A method according to claim 18 further comprising a single-cell pipette handle comprising a first pressure channel connectable to said first branch microchannel of said single-cell pipette tip and a second pressure channel connectable to said second branch microchannel of said single-cell pipette tip.

28. A method according to claim 27 wherein said single-cell pipette tip is separable from said single-cell pipette handle.

29. A method according to claim 27 wherein said first pressure channel of said single-cell pipette handle is connected to said first branch microchannel of said single-cell pipette tip by a first connection tube, and said second pressure channel of said single-cell pipette handle is connected to said second branch microchannel of said single-cell pipette tip by a second connection tube.

30. A method according to claim 29 wherein said first connection tube is detachably connected to said first pressure channel of said single-cell pipette handle and said first branch microchannel of said single-cell pipette tip, and said second connection tube is detachably connected to said second pressure channel of said single-cell pipette handle and said second branch microchannel of said single-cell pipette tip.

31. A method according to claim 29 wherein said single-cell pipette tip is formed integral with said single-cell pipette handle.

32. A method according to claim 18 wherein after said wash solution flushes the slurry of cells out of said base microchannel, with the captured cell remaining in said single-cell trap, and before the captured cell is flushed out of said single-cell trap, culturing the captured cell.

33. A method according to claim 32 wherein said primer solution comprises trypsin.

* * * * *